US005966806A

United States Patent [19]

Maeda et al.

[11] Patent Number: 5,966,806

[45] Date of Patent: Oct. 19, 1999

[54] CONTROL METHOD OF TERMINAL CRIMPING DEVICE

[75] Inventors: Tatsuya Maeda; Chiaki Hatano, both of Shizuoka, Japan

[73] Assignee: Yazaki Corporation, Tokyo, Japan

[21] Appl. No.: 08/871,938

[22] Filed: Jun. 10, 1997

[30] Foreign Application Priority Data

Jun. 12, 1996 [JP] Japan ..... 8-151139

[51] Int. Cl.[6] ..... H01R 43/04

[52] U.S. Cl. ..... 29/863; 29/861; 29/857

[58] Field of Search ..... 29/857, 861, 863

[56] References Cited

U.S. PATENT DOCUMENTS

| | | | |
|---|---|---|---|
| 4,856,186 | 8/1989 | Yeomans | 29/863 |
| 4,916,810 | 4/1990 | Yeomans | 29/863 |
| 5,046,241 | 9/1991 | Ricard | 29/863 |
| 5,092,026 | 3/1992 | Klemmer et al. | 29/593 |
| 5,195,042 | 3/1993 | Ferraro et al. | 364/468 |
| 5,197,186 | 3/1993 | Strong et al. | 29/863 |
| 5,727,409 | 3/1998 | Inoue et al. | 72/21.1 |

OTHER PUBLICATIONS

Inoue, Toshihiro et al.; U.S. Patent Application No. 08/576,019 filed Dec. 21, 1995; *Method of Controlling A Terminal Crimping Apparatus.*

*Primary Examiner*—Lee Young
*Assistant Examiner*—Kevin G Vereene
*Attorney, Agent, or Firm*—Armstrong, Westerman, Hattori, McLeland and Naughton

[57] ABSTRACT

A terminal crimping device is composed of an elevating crimper for crimping terminals onto the exposed conductors of cables and an anvil positioned opposite said crimper. The crimper is caused to ascend and descend by means of drive means including a servo motor. The controlling of the terminal crimping operation is done by monitoring the height of the crimper at the time of terminal crimping and the load applied to said drive means and comparing a detected load to the height with the preset reference data to determine whether the terminal crimping performance is good or not. Thus, a reliable determination whether the terminal crimping performance is good or not is performed.

2 Claims, 9 Drawing Sheets

CONTROL METHOD OF TERMINAL CRIMPING DEVICE

BACKGROUND OF THE INVENTION

1. Field of the Invention

The present invention relates to a method of controlling a terminal crimping device which produces terminal-equipped cables constituting a wire harness, or the like.

2. Description of the Prior Art

The terminal crimping device is, in general, composed of a crimper and an anvil set opposite to said crimper wherein the crimper performs the work of crimping terminals to the exposed conductors of cables through elevating actions thereof. In this connection, Japanese Laid-Open Patent Appln. No. 8-236,253 discloses that the elevating actions of the crimper are achieved by decelerating the rotation of the servo motor before being transmitted to a disk where the disk rotation is converted into a linear motion such that a ram carried by said crimper is elevated and lowered. A detailed explanation thereof will be given with reference to FIG. 10 and FIG. 11.

FIGS. 10A through 10C are figures explaining the action of the terminal crimping device; FIG. 11A is a graph showing the relationship between the crimper action time and the elevating speed; and FIG. 11B is a graph showing the relationship between the time and the motor current value wherein 1, 2, 3 in FIGS. 11A and 11B correspond to A, B and C in FIG. 10.

Referring to FIG. 10, the disk 7 is secured to the output shaft of the decelerator (not shown), which functions to decelerate the rotation of the servo motor.

The disk 7 secured at an axis thereof to the output shaft of the decelerator carries an eccentric pin (crank shaft) 8 thereon. A crank rod 9 is pivotally attached at an upper end thereof to the eccentric pin 8 while the crank rod 9 is pivotally attached at a lower end thereof to a ram 11. The ram 11 is movable slidably in a vertical direction within a ram guide which is provided within the inner surfaces of a frame (not shown)., In this way, the disk 7, the crank rod 9, the ram 11 and the ram guide constitute a piston/crank mechanism.

The ram 11 is formed at a lower end thereof with an engagement recess 13, which is removably loaded with an engagement head 16 of a crimper holder 15 carrying a crimper 14. Immediately beneath the crimper 14, an anvil 17 is secured to a base 2 positioned opposite to said crimper 14.

FIG. 10A shows the start of the crimping step in which the crank pin 8 of the disk 7 takes an uppermost position to place the crimper 14 at the top dead center position, wherein the descending speed of the crimper 14 stands at 0 while the load current stands at 0 as shown in FIG. 11A.

FIG. 10B shows a rotation of the disk 7 in the arrow-marked direction which causes the crank pin 8 to move downward until the crimper 14 reaches a position in its high speed descent to contact the barrel c of a terminal, thus starting a crimping action therefor. The descending speed of the crimper 14 is reduced before the contact thereof while reducing the load current.

FIG. 10C shows that the disk 7 rotates in the arrow-marked direction to move the crank pin 8 to the neighborhood of the bottom dead center position such that the crimper 14 and the anvil 17 substantially perform the crimping work and, then, the crimper 14 provisionally comes to a stop at the crimping position. At this time, the crimper 14 is at rest (stop time t) showing a speed 0 while maintaining the state of pressurizing and pinching the barrel c of the terminal to continue the pressurizing action against the springback of the terminal barrel c, thus the load current reaching the peak value while showing a rising curve. Springback of said barrel c is prevented through this pressurizing and pinching action by this provisional halt.

After termial crimping, the servo motor 4 is caused to rotate the disk 7 in a direction reverse to the arrow-marked direction in the state shown in FIG. 10C such that the crimper 14 ascends to restore to the state (A).

In FIG. 11, the descending speed of the crimper 14 is sufficiently reduced from the speed thereof shown during the descent from the uppermost position to the terminal crimping start position. Therefore, such impact noise as is caused in a conventional flywheel type terminal crimping device will not be generated, thus contributing to noise prevention and job site improvement.

As data for determining whether the terminal crimping performance is good or not, the current value $I_U$ and $I_L$ as shown in FIG. 11B, are stored.

More specifically, FIG. 11B shows that I represents a standard value at the time of a normal step of crimping a given terminal and a given cable size, $I_U$ and $I_L$ represent a high limit and a low limit thereof, the high limit $I_U$ and the low limit $I_L$ being established by a preliminary test. If I is between $I_U$ and Ic, it means the normal crimping, in which the high limit $I_U$ and low limit Ic are established by the preliminary test.

As described in the foregoing, the crimping performance of the conventional terminal crimping device is determined by determining whether the value of electric current at the time of terminal crimping operation is in the preset range thereof. The determination by such a value of electric current alone is susceptible to a significant error to such an extent that values otherwise to be rejected can happen to be among those determined acceptable.

SUMMARY OF THE INVENTION

An object of the present invention to provide an improved method of controlling a terminal crimping device to assure the determination whether the terminal crimping performance is good or not.

In order to attain the above object, there is provided a method of controlling a terminal crimping device according to the present invention having means, which includes an elevating crimper for crimping terminals onto exposed conductors of cables and an anvil positioned opposite the elevating crimper wherein the crimper is caused by drive means including a servo motor to perform an elevating action, the method comprising the steps of monitoring a height of the crimper and a load applied to the drive means at the time of crimping terminals; and comparing a detected load to a detected height with preset reference data to determine whether terminal crimping performance is good or not. Preferably, the reference values of the reference data are given allowances of preset values such that the terminal crimping performance is determined as not good when the load is detected outside of the range of the allowances of the preset values.

Preferably, the values obtained by adding or multiplying the difference between a taken-in peak height load and the reference values to the respective reference values are taken in as new reference values obtained by adding or multiplying the ratio between a taken-in peak height load and the reference values to the respective reference values are taken in as new reference values.

According to the present invention, since the load applied to the drive means at the time of the terminal crimping operation (like those converted into a current value) are monitored in correspondence to the crimper height to determine whether the terminal crimping performance is good or not, a device of simple construction can do a reliable job of such determination.

Since values obtained by adding or multiplying to each reference value the ratio between a taken-in peak height load and the reference values are taken in as new reference values, it is possible to continuously operate the crimping device, resulting in the heat from the servo motor varying the torque and reliably determining whether the performance is good or not.

The above and other object and features of the present invention will be more apparent from the following description taken in conjunction with the accompanying drawings.

DESCRIPTION OF THE PREFERRED EMBODIMENTS

Figure 1:
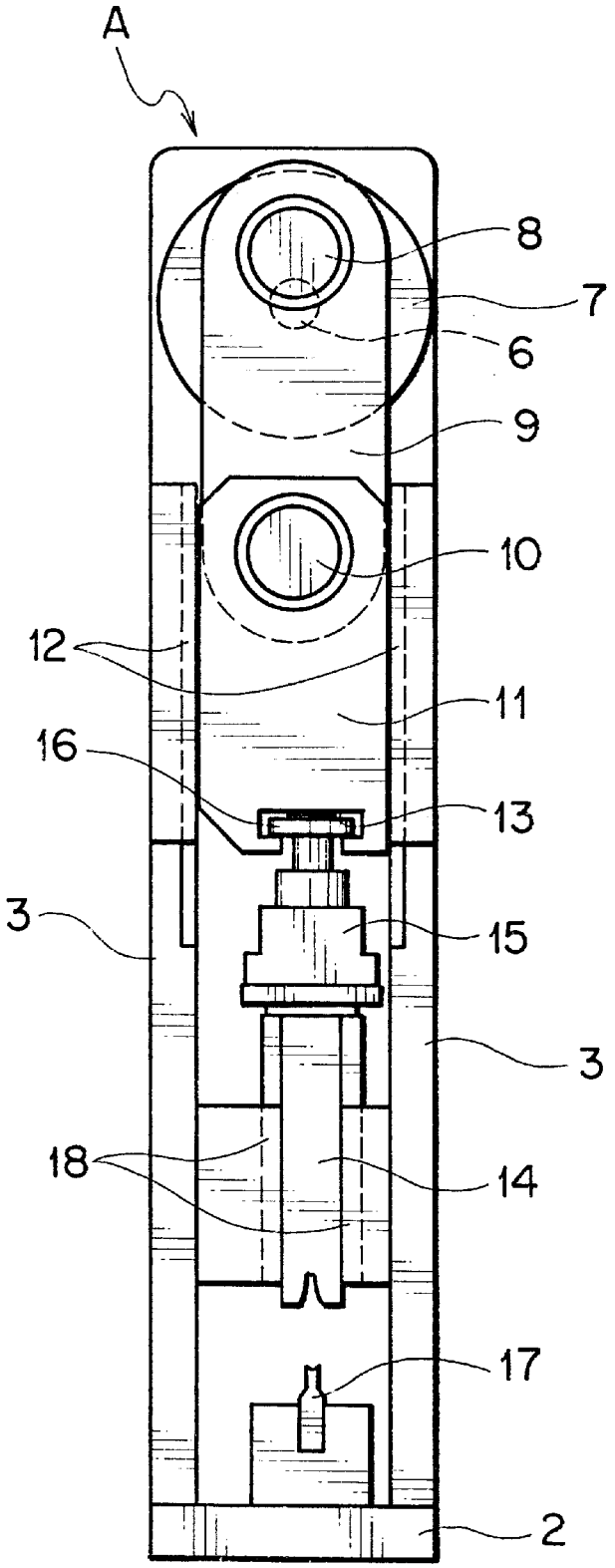
FIG. 1 is a front view of the terminal crimping device, showing one embodiment of the present invention.
Figure 2:
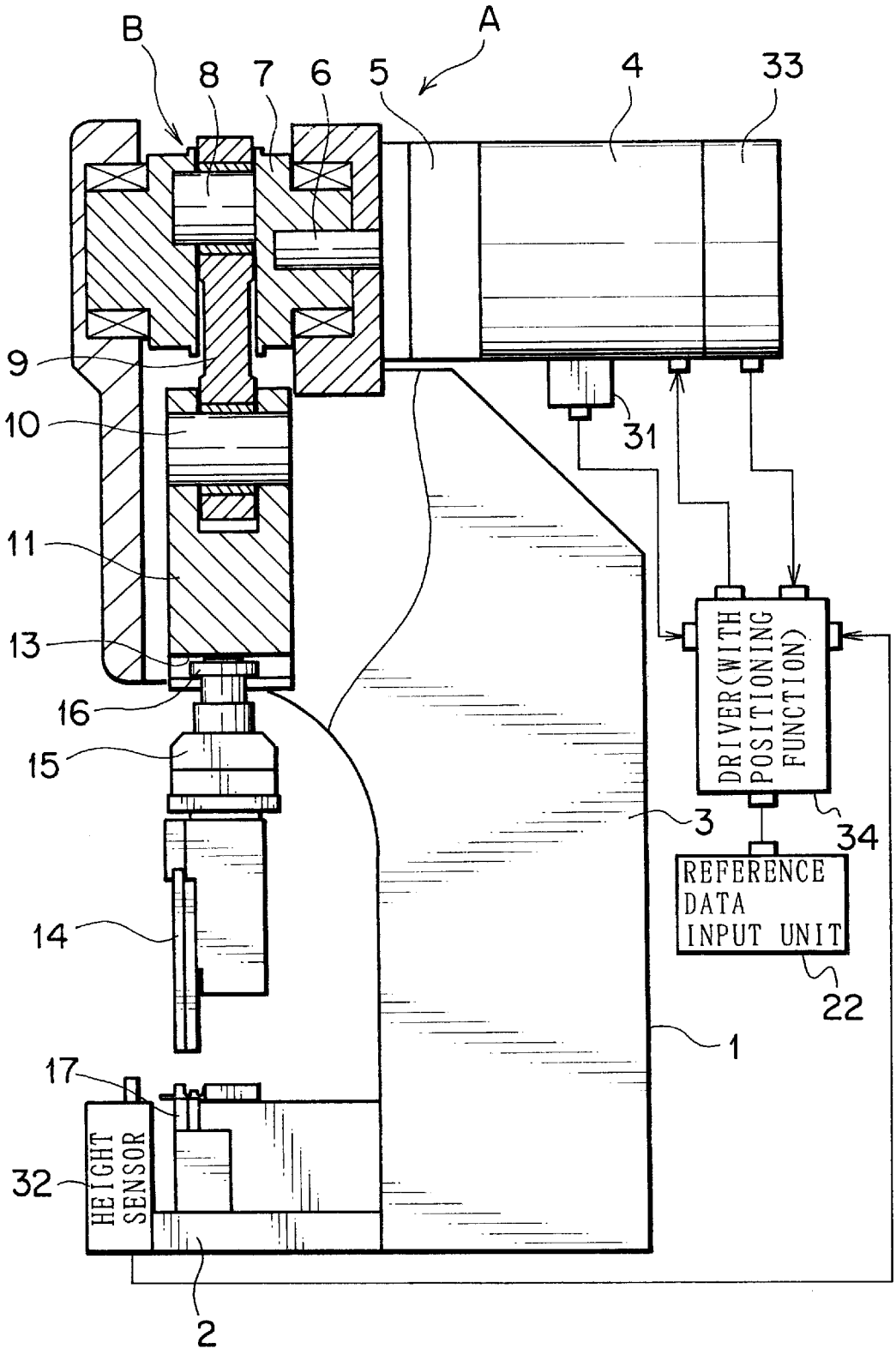
FIG. 2 is a side elevation of FIG. 1.

In FIGS. 1 and 2, reference numeral 1 denotes a casing of a terminal crimping device A which is generally composed of a base 2 and opposite side plates 3 thereof. Above the opposite side plates 3, a servo motor 4 having a reduction gear 5 is mounted thereto to extend rearwardly thereof. Said reduction gear 5 has an output shaft 6 which is secured to a disk 7 having an eccentric pin (crank shaft) 8. There is provided a crank rod 9 having an upper end pivotally attached to the eccentric pin 8. Said crank rod 9 further has a lower end again pivotally attached to a ram 11 via a pin shaft 10. Said ram 11 is loaded within ram guides 12 attached to the inner walls of the opposite side plates 3 such that the ram 11 is adapted to slide upwardly and downwardly therebetween. Thus, the disk 7, the crank rod 9 and the ram guides 12 constitute a piston/crank mechanism B.

The ram 11 is formed with an engagement recess 13 at an underside thereof such that an engagement head 16 formed in the crimper holder 15 attached to the crimper 14 is removably engaged in the engagement recess 13. Immediately beneath the crimper 14, there is set an anvil 17 mounted on the base 2 in opposite relation to the crimper 14. The numeral 18 denotes guide plates for guiding the crimper holder 15 which are secured to the inner faces of the side plates 3 by way of brackets (not shown).

The servo motor 4 is adapted to rotate forwardly and backwardly such that the piston/crank mechanism B causes the ram 11 pivotally attached to the crank rod 9 and, thus, the crimper 14 to descend and ascend, the motor 4 being connected to the driver 34 which controls the operation thereof. A reference data input unit 22 to the driver 34 is connected to the driver 34 for inputting thereto reference data including terminal standards (or sizes), cable sizes corresponding thereto, crimper heights (or lowest crimper positions) and loads (or electric currents) applied to the servo motor 4, or the like.

The servo motor 4 has an output shaft (not shown) attached to a rotary encoder 33 which detects positions of the crimper 14 on the basis of the number of its rotation to be fed back to the driver 34 which reads out the load current.

Numeral 32 denotes a height sensor which detects the height of the crimper 14 at the time of terminal crimping operation to input the same to the driver 34 for determining whether the performance of the terminal attaching operation is good or not. The numeral 31 denotes a temperature sensor for measuring the temperature of the coil of the servo motor 4.

Figure 3:
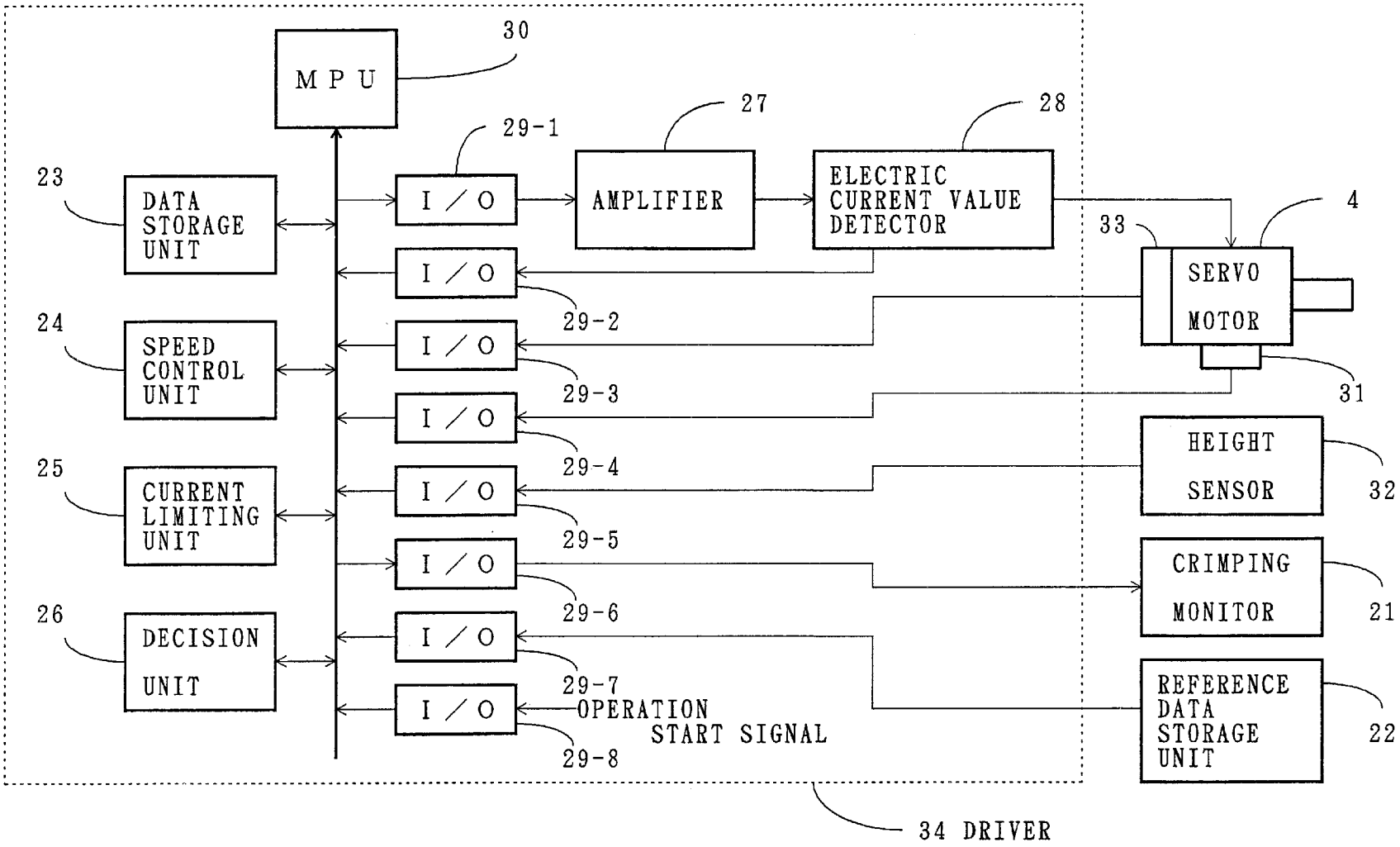
FIG. 3 is a function block diagram showing the control sequence of the terminal crimping device of FIG. 1.

FIG. 3 is a function block diagram of the driver 34 which drives the servo motor 4. As shown therein, the driver 34 is incorporated as a control circuit like a central processing unit; that is, the driver 34 is composed of data storage unit 23, speed control unit 24, current limiter 25, a decision unit 26, amplifier 27, a electric current value detector 28, an interface (I/O) 29 (29-1 through 29-8) and a microprocessor (MPU) 30 which performs the processing work.

Figure 11A:
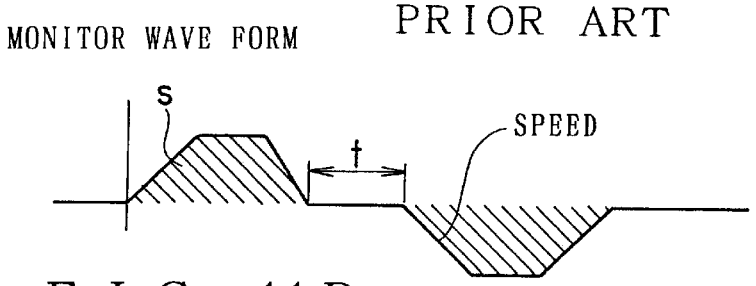
FIG. 11A PRIOR ART
FIG. 11A is a graph showing the relationship the time and the ascending/descending speed of the crimper at the time of crimping operation.
Figures 10A, 10B, 10C:
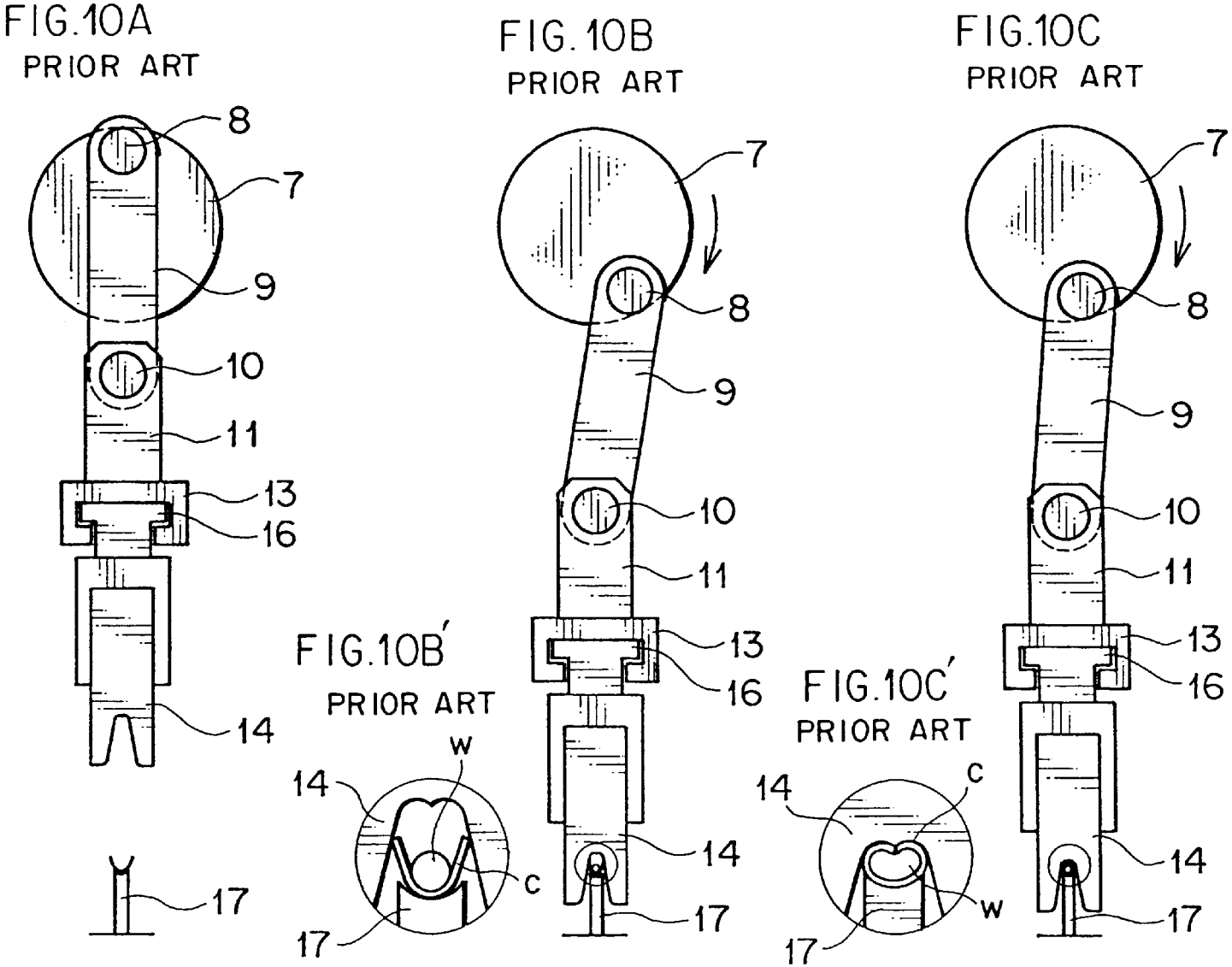
FIG.10A PRIOR ART
FIG.10B PRIOR ART
FIG.10B' PRIOR ART
FIG.10C PRIOR ART
FIG.10C' PRIOR ART
FIGS. 10A, 10B, 10B', 10C and 10C' are views explaining the operation of the terminal crimping device (shown in FIG. 1)

The operating principle of the terminal crimping device will not be explained since it is substantially the same as explained referring to FIGS. 10 and 11 which show the prior art.

Now back to FIG. 3, data for driving the terminal crimping device A and data for determining whether the performance of the terminal crimping operation is good or not will be stored in advance into the data storage unit 23 by way of I/O 29-7 from the reference data input unit 22 prior to starting the operation of the terminal crimping device A.

Figure 11B:
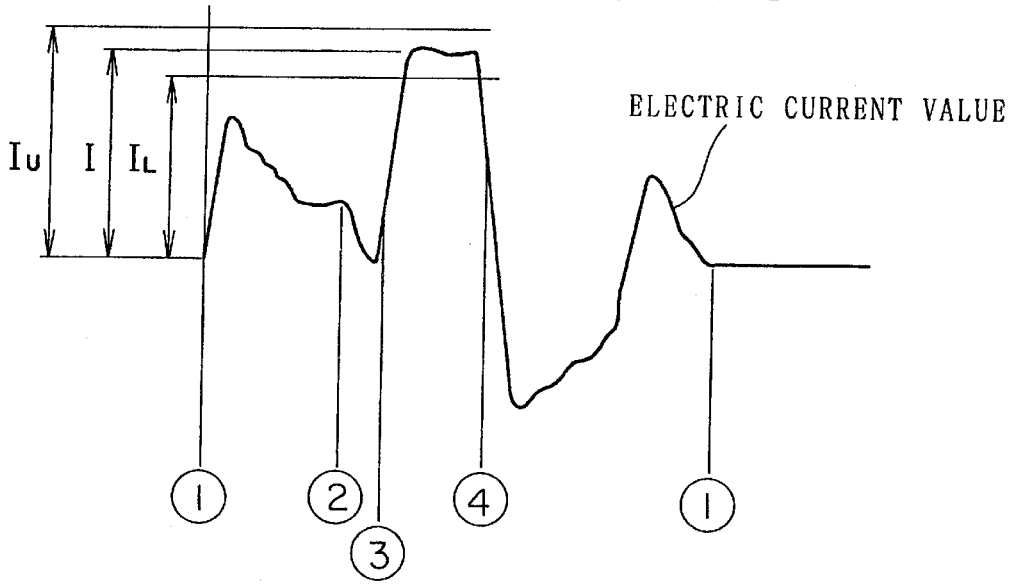
FIG. 11B PRIOR ART
FIG. 11B is a similar graph showing the relationship between the time and the motor current.

More specifically, the data to be stored for driving the terminal crimping device A, as shown in FIG. 11B, include (i) the acceleration after the start of a forward rotation of the motor and the position of the crimper 14 descending by the rotation of the motor at the time of the motor reaching a uniform speed, (ii) the position of the crimper 14 decelerated from the uniform speed and the deceleration at that time, iii) the position of the crimper 14 at the time of starting the crimping, the given time period t and the drive current for driving the motor for the given time period, and iv) the acceleration at the time of reversing the motor after completion of the crimping to elevate the crimper 14, the position of the crimper 14 when the motor speed is brought to a uniform speed, the position of the crimper 14 when the motor is decelerated, and the position of the crimper 14 at a stop.

The positions of the crimper 14 are stored as values related to the output values of the rotary encoder 33 attached to the servo motor 4.

These data are obtained by conducting preliminary experiments for respective terminals to be press attached and the thus obtained data are stored. In this connection, the data corresponding to a plurality of terminals may be stored such that relevant data are to be read out at the time of the operation.

The positions of the crimper 14 are to be stored in the form of values corresponding to the rotational angles of the disk 7 such that there is no need for varying the level of the anvil, as required in the prior art, even in the event of terminal replacement; that is, the procedure can be followed immediately to facilitate the adjustment of the crimper position at the start of crimping.

The data for determining whether the performance of the terminal crimping operation is good or not will be explained later on.

Figure 4:
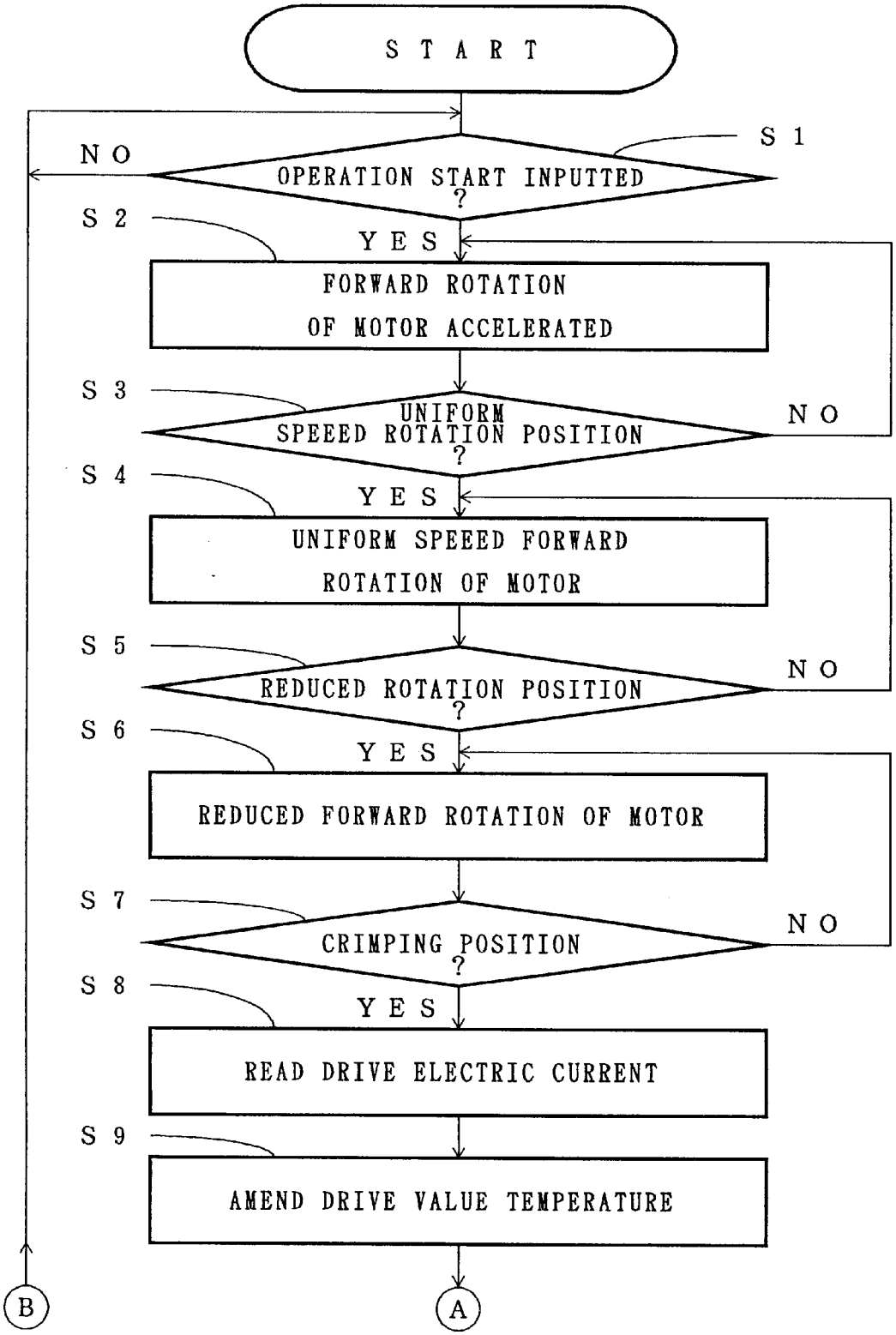
FIG. 4 is a flow chart showing the operation of FIG. 3.
Figure 5:
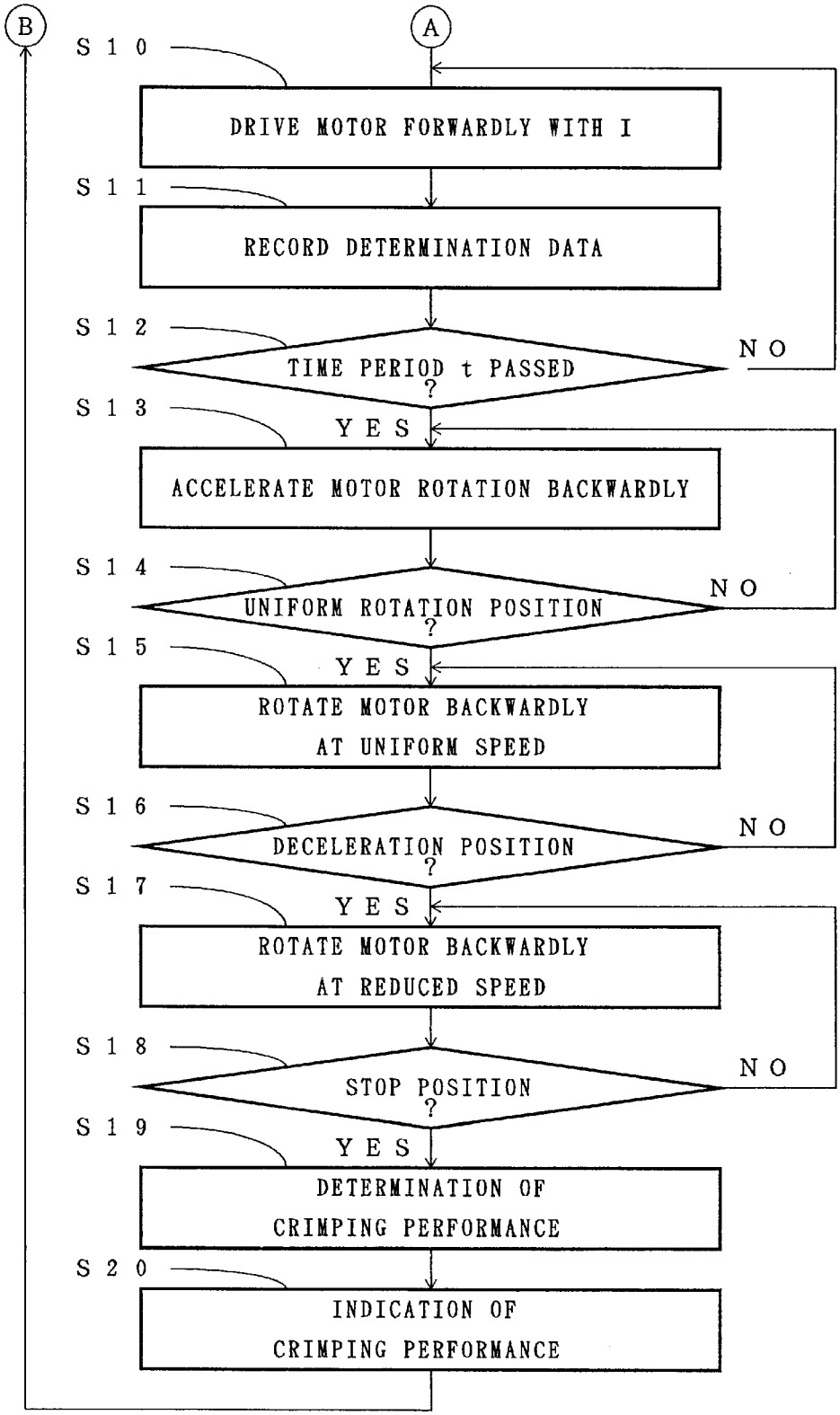
FIG. 5 is a flow chart showing the operation of FIG. 3.

Next, the operation of the driver 34 will be explained with reference to FIGS. 4 and 5, which show a flow chart of the driver operation.

At step S1, the speed control unit 24 determines whether or not the signal for starting the crimping operation has been inputted and if the determination is NO, the program is suspended until YES.

At step S2, the speed control unit 24 reads out from the data storage unit 23 the acceleration for causing the servo motor 4 to rotate forwardly and the acceleration is outputted to the amplifier 27 by way of I/O 29-1 where the power amplification is effected to supply the electric current to the servo motor 4 such that the required speed is obtained.

In this connection, the acceleration for the motor rotation is obtained by reading out the output value of the rotary encoder 33 by way of I/O 29-3, differentiating the read out value to obtain the speed, and further differentiating the speed to obtain the acceleration.

At the step S3, the speed control section 24 determines whether or not the output value of the rotary encoder 33 inputted by way of I/O 29-3 has become a uniform rotation position and if the determination is NO, the acceleration applied at step S2 is continuously effected and if YES, the program proceeds to step S4 where the uniform speed rotation is effected.

Further, if the position for decelerated rotation is detected at the step S5, the program proceeds to step S6 where the speed control unit 24 reduces the motor rotation. At step 7, the terminal reaches the crimping position, when the current control unit 25 is thus notified.

At step S8, the current control unit 25 reads out the electric current value I which is stored at the data storage unit 23 to be supplied to the servo motor 4 at the time of terminal crimping operation. Then, the program proceeds to step S9 where an amendment is made thereto on the basis of the temperature value from the temperature sensor 31 inputted by way of I/O 29-4 such that the torque of the servo motor 4 reaches the prescribed value to output the value at step S10 by way of I/O 29-1.

At step S11, the decision unit 26 stores the determination data to a memory not shown. Said data for determination will be explained in detail later on.

At step 12, the electric current control unit 25 determines whether or not the electric current I is supplied to the servo motor 4 for a time period t and if the determination is NO, the program proceeds to the step S10 for execution of the steps S10 and S11.

At step 13, the speed control unit 24 causes the servo motor 4 to rotate by accelerating the same to obtain a designated acceleration in the backward direction until a value for the uniform speed rotation is determined at step S14 as having been obtained.

Then, the program proceeds to step S15 to achieve a uniform speed rotation. At the step 16, if the position for reduction speed rotation is determined as having been reached, the program proceeds to step S17 for decelerated rotation, and at step S18 the rotation is stopped when the stop position is reached.

At step S19, the decision unit 26 determines whether crimping is good or not on the basis of the data recorded at the step S11. Then, at the step 20, an alarm is issued if necessary in the event of "not good" while the result is displayed 21 on the crimping monitor 21.

The determination whether the crimping is good or not is recorded at the step Sll as shown in FIG. 11, at an interval of predetermined time period in the form of the electric current value (drive value) detected by the current value detector 28 as having flowed through the servo motor 4 and the height detected by the height sensor 32 are recorded.

The current control unit 25 controls such that the uniform electric current having a value stored at the data storage unit 23 is supplied to the motor. Although a uniform electric current is supplied while the motor is at a stop, the control balance is lost by the crimping operation when the motor starts to rotate with the result that the drive electric current varies. When crimping a terminal to a coreless cable or an unpeeled cable, it is often observed that the current supplied is larger than when crimping a normal terminal or that the total supply electric current is smaller. Therefore, the determination of good or not in accordance with the preset amount is effected on the basis of a variation of the current supplied in correspondence with the crimping height.

Figure 7:
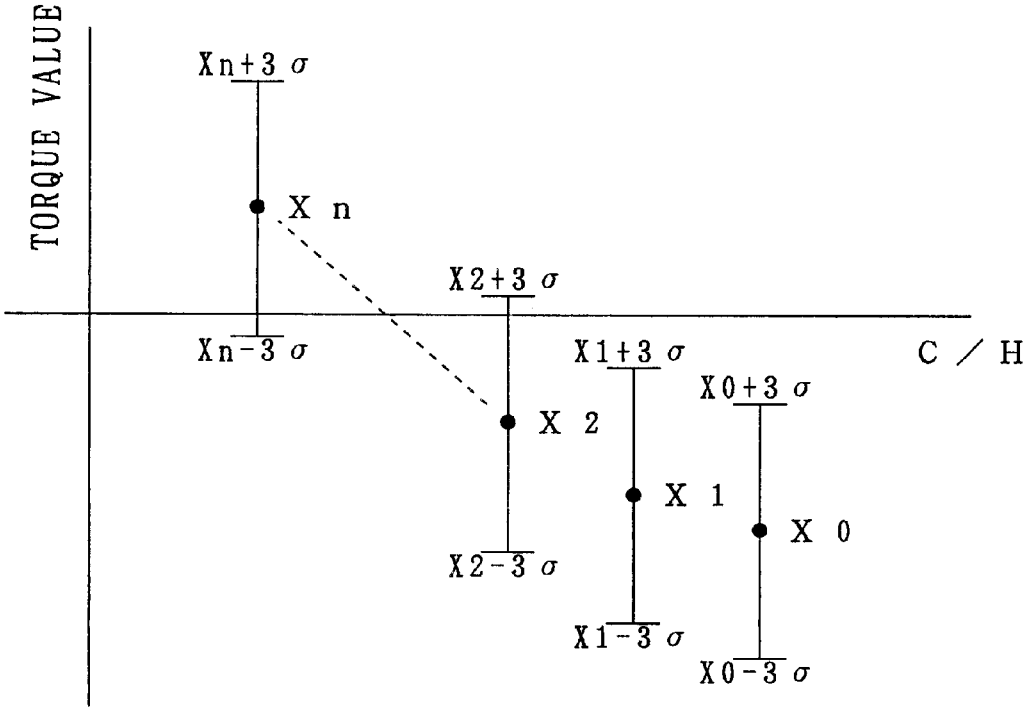
FIG. 7 is a view for explaining the determination value.

At the determination unit 26, there are recorded reference values X0, X1, X2 - - - Xn of the torque value (electric current value) to the crimp height (C/H) as shown in FIG. 7 and predetermined values ($3\sigma$) to the respective reference values X0, X1, X2 - - - Xn.

At step S19, the decision unit 26 determines whether or not the data values recorded at step Sll are within the range of predetermined allowances as explained referring to FIG. 7 and if the value is within the range, it is determined "good", and if outside thereof, it is determined "not good".

Figure 6:
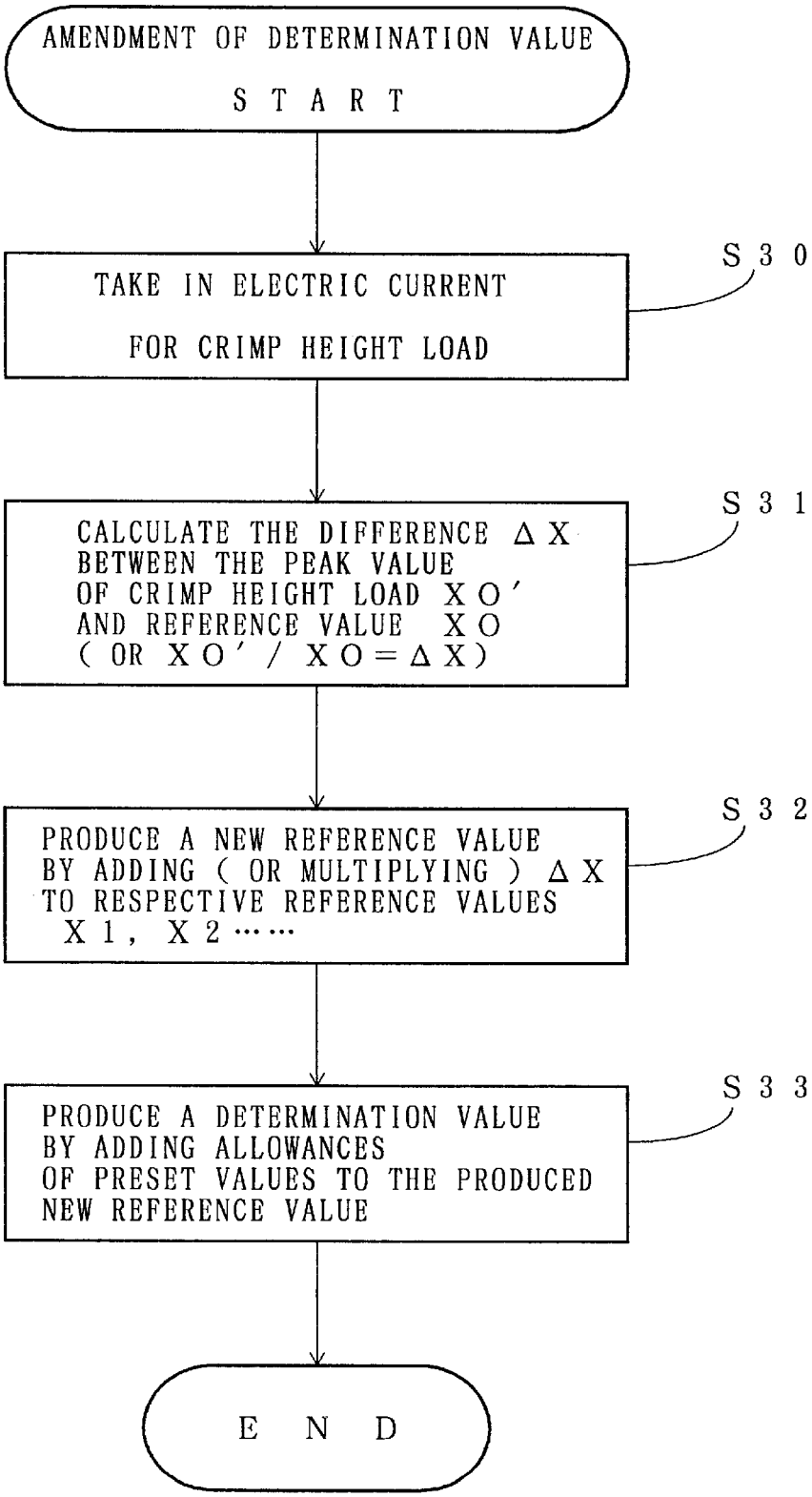
FIG. 6 is a flow chart showing the determination value amending operation.

Further, the determination unit 26 effects a continuous operation of the terminal crimping device and makes an amendment to the determined value in accordance with the operation shown in FIG. 6 in case the servo motor 4 is heated to change the torque.

At the step 30, the crimp height detected by the height sensor 32 and the electric current value obtained from the I/O 29-5 are taken in.

At step 31, the difference $\Delta X$ between the peak value load X0' and the reference value X0 or the ratio $\Delta X$ of the X0' to X0 is calculated.

At the step S32, $\Delta X$ calculated at the step S31 and added or multiplied to the respective reference values X0, X1, X2, - - - Xn or multiplied thereby is obtained as new reference values.

At the step S33, a predetermined allowance is added to the new reference value obtained by calculation conducted at step S32 to obtain the decision value, thus completing the amendment to the determination value.

Figure 8:
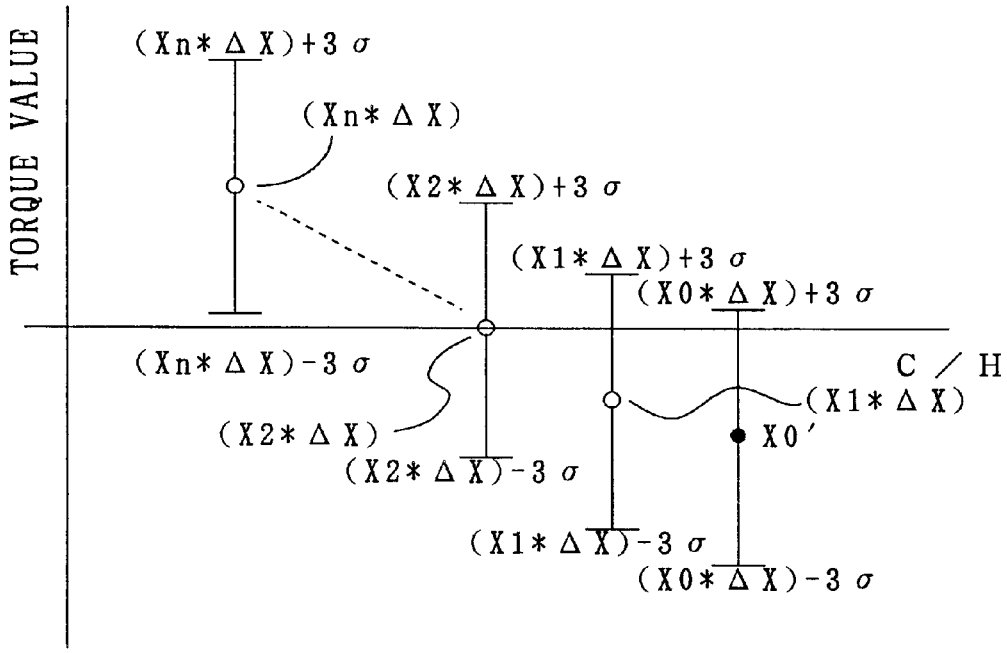
FIG. 8 is a view for explaining the determination value amendment.
Figure 9:
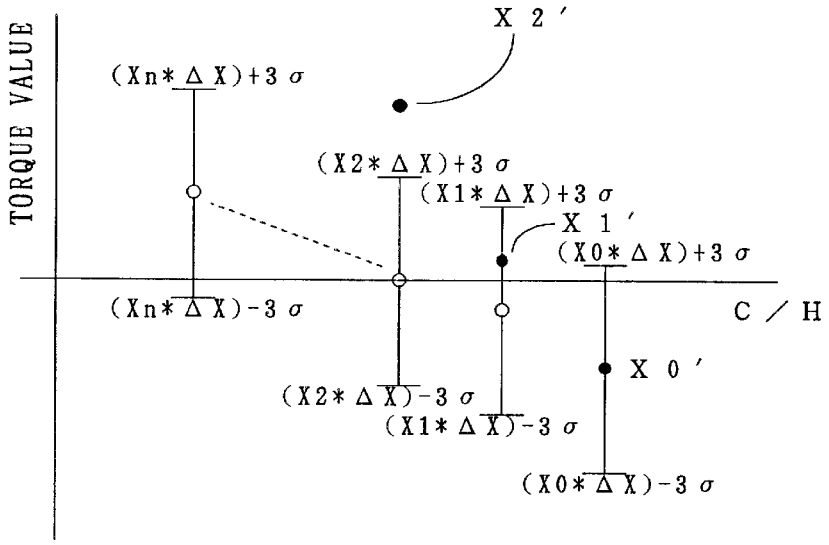
FIG. 9 is a view for explaining the amended determination value.

More specifically, $\Delta X$ is obtained at step S31, as shown in FIG. 8, on the basis of the reference XO to the load current value X0' (shown in black dots) to the peak value of the crimp height taken in at step S30 by conducting an arithmetic operation as follows:

$$X0'-X0=\Delta X$$

or $X0'/X0=\Delta X$

Next, with regard to respective reference values X0, X1, X2 - - - Xn at the step 32, the arithmetic operations such as $(X0*\Delta X), (X1*\Delta X), (X2*\Delta X), - - - (Xn*\Delta X)$, or $(X0+\Delta X), (X1+\Delta X), (X2+\Delta X), - - - (Xn+\Delta X)$ are conducted to produce new reference values.

At the step 33, the determination values such as $(X0*\Delta X+3), (X1*\Delta X+3), (X2*\Delta X+3),$ - - - $(Xn*\Delta X+3)$ or $(X0+\Delta X+3), (X1+\Delta X+3), (X2+\Delta X+3), - - - (Xn+\Delta X+3)$ are produced by adding a predetermined value ($3\sigma$) to the new reference values produced at the step 32.

On the basis of the thus produced new determination values, it is determined whether the taken-in values such as X1', X2', - - - Xn' are out of the range of determination values or not and if out of the range, the crimping are determined "not good".

Since amendments are made to the determination values as shown in the foregoing description, reliable determinations are made even in the event of any torque variation due to heated servo motor 4.

What is claimed is:

1. A method of controlling a terminal crimping device composed of a reciprocating crimper for crimping terminals onto exposed conductors of cables and an anvil positioned opposite to the crimper wherein the crimper is caused by drive means, including a servo motor, to perform a reciprocating action, the method comprising the steps of:

operating the drive means to reciprocate the crimper between an elevated position and a position in which the terminals are crimped;

monitoring a height of the crimper and an electric load applied to the drive means at the time of crimping terminals;

determining a detected electric load with respect to the detected crimper height, and comparing the same with present reference data to determine whether the terminal crimping performance is good or not, wherein reference values of the reference data are given allowances of preset values such that the terminal crimping performance is determined as not good when a load is detected outside a range of the allowances of the preset values, and wherein values obtained by adding or multiplying a difference between a determined peak height load and values of reference data to the respective values of reference data are considered as new reference values.

2. A method of controlling a terminal crimping device composed of a reciprocating crimper for crimping terminals onto exposed conductors of cables and an anvil positioned opposite to the crimper wherein the crimper is caused by drive means, including a servo motor, to perform a reciprocating action, the method comprising the steps of:

operating the drive means to reciprocate the crimper between an elevated position and a position in which the terminals are crimped;

monitoring a height of the crimper and an electric load applied to the drive means at the time of crimping terminals;

determining a detected electric load with respect to the detected crimper height, and comparing the same with preset reference data to determine whether the terminal crimping performance is good or not, wherein reference values of the reference data are given allowances of preset values such that the terminal crimping performance is determined as not good when a load is detected outside a range of the allowances of the preset values, and wherein values obtained by adding or multiplying a ratio between a determined peak height load and values of reference data to the respective values of reference data are considered as new reference values.

* * * * *